US009004652B2

(12) United States Patent
Nystrom et al.

(10) Patent No.: US 9,004,652 B2
(45) Date of Patent: Apr. 14, 2015

(54) THERMO-PNEUMATIC ACTUATOR FABRICATED USING SILICON-ON-INSULATOR (SOI)

(71) Applicant: Xerox Corporation, Norwalk, CT (US)

(72) Inventors: Peter J. Nystrom, Webster, NY (US); Andrew W. Hays, Fairport, NY (US); Peter M. Gulvin, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 14/020,368

(22) Filed: Sep. 6, 2013

(65) Prior Publication Data

US 2015/0070440 A1 Mar. 12, 2015

(51) Int. Cl.

| | |
|---|---|
| ***B41J 2/05*** | (2006.01) |
| ***B41J 2/14*** | (2006.01) |
| ***B41J 2/16*** | (2006.01) |

(52) U.S. Cl.

CPC ..... *B41J 2/14427* (2013.01); *B41J 2/1601* (2013.01); *B41J 2/14064* (2013.01)

(58) Field of Classification Search

CPC ..... B41J 2/14064
USPC ..... 347/20, 44, 47, 54, 61–65, 67, 84–87
See application file for complete search history.

(56) References Cited

U.S. PATENT DOCUMENTS

| | | | | |
|---|---|---|---|---|
| 5,467,112 | A | 11/1995 | Mitani | |
| 5,539,437 | A | 7/1996 | Penwell | |
| 5,943,074 | A | 8/1999 | Kashino et al. | |
| 6,074,043 | A | 6/2000 | Ahn | |
| 6,130,690 | A | 10/2000 | Ahn | |
| 6,199,600 | B1 | 3/2001 | Ahn et al. | |
| 6,206,505 | B1 | 3/2001 | Yoshihira et al. | |
| 6,270,197 | B1 | 8/2001 | Ahn et al. | |
| 6,270,198 | B1 | 8/2001 | Ahn et al. | |
| 6,276,783 | B1 | 8/2001 | Ishinaga et al. | |
| 6,284,436 | B1 | 9/2001 | Ahn et al. | |
| 6,286,940 | B1 | 9/2001 | Sugiyama et al. | |
| 6,312,109 | B1 | 11/2001 | Chen | |
| 6,315,398 | B1 | 11/2001 | Burke et al. | |
| 6,328,430 | B1 * | 12/2001 | Ahn et al. | 347/65 |
| 6,334,670 | B1 | 1/2002 | Yoshihira et al. | |
| 6,367,705 | B1 | 4/2002 | Lee et al. | |
| 6,378,991 | B1 | 4/2002 | Lim et al. | |

(Continued)

FOREIGN PATENT DOCUMENTS

| | | |
|---|---|---|
| CA | 2290916 A1 | 6/2000 |
| EP | 6651066 A2 | 8/1995 |

(Continued)

*Primary Examiner* — Juanita D Jackson
(74) *Attorney, Agent, or Firm* — MH2 Technology Law Group LLP

(57) ABSTRACT

An ink jet printhead including a thermo-pneumatic actuator array for ejecting ink from an array of nozzles. The actuator array may include the use of a silicon-on-insulator (SOI) semiconductor wafer including a device layer, a handle layer, and a dielectric layer that physically separates the device layer from the handle layer to simplify printhead formation. During an exemplary process, the SOI wafer is attached to a heater wafer and a nozzle plate is attached to the dielectric layer such that, during use of the printhead, the device layer functions as an actuator membrane. Deflection of the device layer during use of the printhead creates a pressure within an ink chamber which causes ejection of ink from one of the nozzles of the array of nozzles.

20 Claims, 5 Drawing Sheets

(56) References Cited

U.S. PATENT DOCUMENTS

| | | | | |
|---|---|---|---|---|
| 6,386,686 | B1 | 5/2002 | Kubota et al. | |
| 6,390,604 | B2 | 5/2002 | Kashino et al. | |
| 6,431,688 | B1 | 8/2002 | Shin et al. | |
| 6,436,301 | B1 | 8/2002 | Hiroki et al. | |
| 6,443,552 | B1 | 9/2002 | Inoue et al. | |
| 6,540,336 | B2 | 4/2003 | Kubota et al. | |
| 6,705,716 | B2 | 3/2004 | Mott | |
| 6,811,238 | B2 * | 11/2004 | Shingyohuchi | 347/68 |
| 2001/0003460 | A1 | 6/2001 | Yoshihira et al. | |
| 2003/0063162 | A1 | 4/2003 | Yoshihira et al. | |

FOREIGN PATENT DOCUMENTS

| | | | |
|---|---|---|---|
| EP | 816083 | A2 | 1/1998 |
| EP | 1122069 | A1 | 8/2001 |
| EP | 1136271 | A1 | 9/2001 |
| EP | 1302321 | A2 | 4/2003 |
| GB | 2286157 | A | 8/1995 |

* cited by examiner

THERMO-PNEUMATIC ACTUATOR FABRICATED USING SILICON-ON-INSULATOR (SOI)

TECHNICAL FIELD

The present teachings relate to the field of ink jet printing devices and, more particularly, to methods and structures for an array of ink jet printhead actuators.

BACKGROUND

Drop on demand ink jet technology is widely used in the printing industry. Printers using drop on demand ink jet technology can use either thermal ink jet (TIJ) technology or piezoelectric (PZT) technology. In contrast to thermal ink jet printheads, printheads using piezoelectric technology are more expensive to manufacture but may use a wider variety of inks. Piezoelectric printheads are also relatively larger than thermal printheads for the same nozzle count, which may require a wider spacing of nozzles from which ink is ejected during printing and result in a lower ink drop density and velocity. Low drop velocity decreases the tolerance for drop velocity variation and directionality which, in turn, may decrease image quality and printing speed.

Piezoelectric ink jet printheads may include an array of piezoelectric elements (i.e., transducers). One process to form the array can include detachably bonding a blanket piezoelectric layer to a transfer carrier with an adhesive, and dicing the blanket piezoelectric layer to form a plurality of individual piezoelectric elements. A plurality of dicing saw passes can be used to remove all the piezoelectric material between adjacent piezoelectric elements to provide the correct spacing between each piezoelectric element.

Piezoelectric ink jet printheads can typically further include a flexible diaphragm to which the array of piezoelectric elements is attached. When a voltage is applied to a piezoelectric element, typically through electrical connection with an electrode electrically coupled to a power source, the piezoelectric element bends or deflects, causing the diaphragm to flex which expels a quantity of ink from a chamber through a nozzle. The flexing further draws ink into the chamber from a main ink reservoir through an opening to replace the expelled ink.

Thermal ink jet printheads include a thermal energy generator or heater element, usually a resistor, separated from a nozzle within a nozzle plate by an ink channel. Each heater element may be individually addressed so that an activation of an electrical pulse heats the resistor. The heat is transferred from the heater to the ink, which causes a bubble to form within the ink. For example, a water-based ink reaches a critical temperature of 280° C. for bubble nucleation. The nucleated bubble or water vapor thermally isolates the ink from the heater element to prevent further transfer of heat from the resistor to the ink, and the electrical pulse is deactivated. The nucleating bubble expands until excess heat diffuses away from the ink. During the expansion of the vapor bubble, the ink is forced toward the nozzle and begins to bulge at the exterior of the nozzle plate, but is contained by surface tension of the ink as a meniscus.

When the electrical pulse is deactivated, excess heat is diffuses away from the ink and the bubble begins to contract and collapse. The ink within the channel between the bubble and the nozzle begins to move toward the contracting bubble, causing a separation of the ink bulging from the nozzle plate and forms an ink droplet. Acceleration of ink out of the nozzle during the expansion of the bubble provides the momentum and velocity to expel the ink droplet from the nozzle toward a recording medium such as paper in a substantially straight line direction. Once the ink is ejected from the nozzle, the channel may be re-fired after a delay that is sufficient to enable refilling of ink within the channel. A thermal printhead design is discussed in U.S. Pat. No. 6,315,398, incorporated herein by reference in its entirety.

Another type of printhead includes the use of thermo-pneumatic actuators (TPA's). TPA's are similar to thermo-pneumatic (TP) micro-pumps, but do not include inlet and outlet valves. Most printheads rely on surface tension, meniscus pressures, and ink flow impedance to manage fluid flow. In contrast, printheads employing the use of TPA's use a membrane to separate a pumped fluid (e.g., ink) from a working or trapped fluid that is sealed within each actuator. Because the ink itself may have less than optimal thermal characteristics, the working fluid is selected for its improved thermal performance during operation of the device. The membrane isolates the working fluid and prevents it from mixing with the pumped fluid. A lower half of the TPA (the portion beneath the membrane) includes a resistive heater and the working fluid, while the upper half of the TPA (the portion between the membrane and the nozzle plate) includes the pumped fluid.

A simplified printhead device design and manufacturing process that allow for precise control of device geometry and decreased manufacturing costs would be desirable.

SUMMARY

The following presents a simplified summary in order to provide a basic understanding of some aspects of one or more embodiments of the present teachings. This summary is not an extensive overview, nor is it intended to identify key or critical elements of the present teachings, nor to delineate the scope of the disclosure. Rather, its primary purpose is merely to present one or more concepts in simplified form as a prelude to the detailed description presented later.

In an embodiment of the present teachings, a printhead including a plurality of thermo-pneumatic actuators as part of a thermo-pneumatic actuator array may include: a heater wafer including a substrate and a plurality of resistors formed over the substrate, wherein each resistor of the plurality of resistors is individually addressable; a silicon-on-insulator (SOI) wafer including a device layer that provides a thermo-pneumatic actuatable membrane between a working fluid chamber and an ink chamber for each of the plurality of thermo-pneumatic actuators, a dielectric layer attached to the device layer, and a handle layer attached to the dielectric layer, wherein the dielectric layer physically separates the device layer from the handle layer; and a nozzle plate including a plurality of nozzles, wherein the nozzle plate is attached to the handle layer.

In another embodiment of the present teachings, a method for forming a printhead including a plurality of thermo-pneumatic actuators as part of a thermo-pneumatic actuator array may include forming a plurality of individually addressable resistors over a substrate, forming a patterned standoff layer over the substrate, wherein an opening in the patterned standoff layer exposes a region over each resistor of the plurality of resistors, attaching a device layer of a silicon-on-insulator (SOI) wafer to the patterned standoff layer to form a working fluid chamber from the exposed region over each resistor of the plurality of resistors, thereby forming a plurality of working fluid chambers, and etching a handle layer of the SOI wafer using a dielectric layer of the SOI wafer as an etch stop layer to form a plurality of recesses within the handle layer, wherein each recess overlies one of the resistors. The method may further include attaching a nozzle plate including a plurality of nozzles to the handle layer, wherein an ink chamber is defined by each recess of the plurality of recesses in the handle layer and the device layer of the SOI wafer provides a thermo-pneumatic actuatable membrane between the working fluid chamber and the ink chamber for each of the plurality of thermo-pneumatic actuators.

In another embodiment of the present teachings, a printer may include a printhead including a plurality of thermo-pneumatic actuators as part of a thermo-pneumatic actuator array, wherein the thermo-pneumatic actuator array includes a heater wafer including: a substrate; and a plurality of resistors formed over the substrate, wherein each resistor of the plurality of resistors is individually addressable. The printer may further include a silicon-on-insulator (SOI) wafer including: a device layer that provides a thermo-pneumatic actuatable membrane between a working fluid chamber and an ink chamber for each of the plurality of thermo-pneumatic actuators; a dielectric layer attached to the device layer; and a handle layer attached to the dielectric layer, wherein the dielectric layer physically separates the device layer from the handle layer. Further, the printer may include a nozzle plate including a plurality of nozzles, wherein the nozzle plate is attached to the handle layer and a printer housing that encases the printhead.

BRIEF DESCRIPTION OF THE DRAWINGS

The accompanying drawings, which are incorporated in and constitute a part of this specification, illustrate embodiments of the present teachings and together with the description, serve to explain the principles of the disclosure. In the figures.

It should be noted that some details of the FIGS. have been simplified and are drawn to facilitate understanding of the present teachings rather than to maintain strict structural accuracy, detail, and scale.

DETAILED DESCRIPTION

Reference will now be made in detail to exemplary embodiments of the present teachings, examples of which are illustrated in the accompanying drawings. Wherever possible, the same reference numbers will be used throughout the drawings to refer to the same or like parts.

As used herein, unless otherwise specified, the word "printer" encompasses any apparatus that performs a print outputting function for any purpose, such as a digital copier, bookmaking machine, facsimile machine, a multi-function machine, electrostatographic device, etc.

An embodiment of the present teachings may include a printhead including the use of a plurality of thermo-pneumatic actuators (TPA's) to eject ink through a plurality of nozzles onto a recording medium such as paper. A working fluid of each TPA may be separated from a pumped fluid by an actuatable membrane. In an embodiment, the membrane may include the use of a silicon-on-insulator (SOI) wafer or wafer section (hereinafter, SOI wafer) to form a continuous membrane across the plurality of TPA's. The use of a SOI wafer may simplify manufacture and decreases costs of a printhead.

Figure 1:
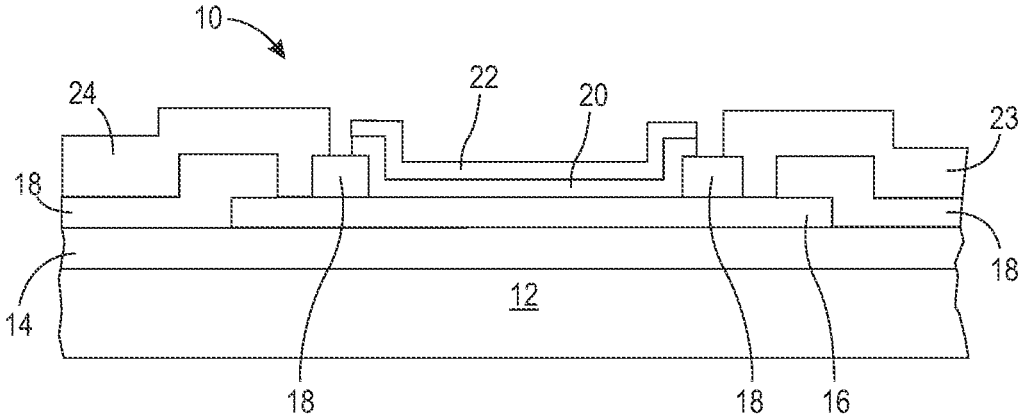
FIGS. 1-6 are cross sections depicting in-process structures in accordance with an embodiment of the present teachings.

U.S. Pat. No. 6,315,398, incorporated by reference above, discloses a printing device. In-process structures which can be formed during an embodiment of the present teachings are depicted in FIGS. 1-6. FIG. 1 depicts an exemplary heater wafer 10 that may be formed by one of ordinary skill in the art and used in an embodiment of the present teachings, although other heater designs are contemplated. It will be understood that the embodiments depicted in each of the FIGS. are generalized schematic illustrations and that other components may added or existing components may be removed or modified.

The heater wafer 10 of FIG. 1 includes a substrate 12 such as a semiconductor (silicon, gallium arsenide, etc.) substrate, which may include various other structures such as ion-doped regions, dielectric layers, and conductive layers formed thereon and/or therein (not individually depicted for simplicity). Further, an underglaze layer 14, for example a dielectric layer such as silicon dioxide ($SiO_2$), may be formed as an isolation region. A patterned resistor 16 (i.e., a resistive heating element) may then be formed on the underglaze layer 14 using, for example, a chemical vapor deposition (CVD) of polysilicon, a metal, or a metal alloy.

Figure 4:
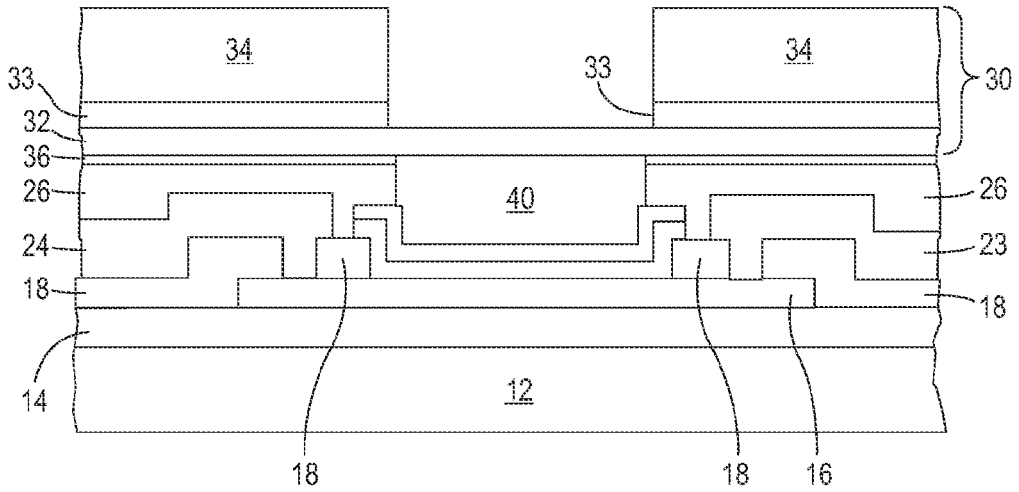
Figure 5:
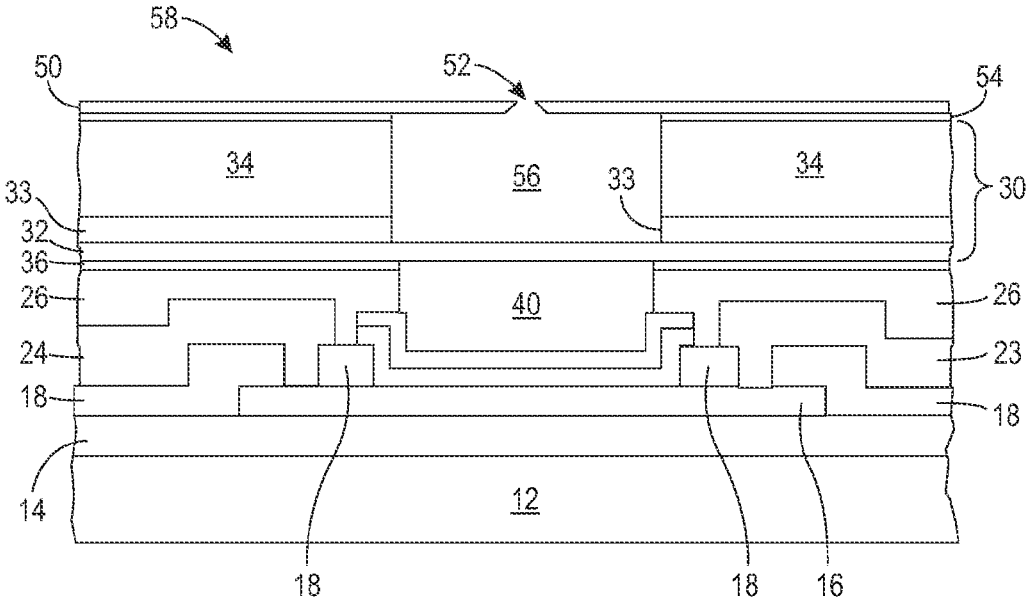

It will be appreciated that, while only one resistor 16 is depicted in FIG. 1, a plurality of resistors 16, as well as the other structures of FIGS. 1-6, may be repeated across the substrate 12 and simultaneously formed as a resistor array, with one resistor 16 associated with each nozzle 56 (FIG. 5, discussed below). Further, in another embodiment, each resistor 16 of the heater wafer 10 may be provided by one or more implanted region within the substrate 12 (not individually depicted for simplicity) rather than being a separate individual layer overlying the substrate 12 as depicted in FIG. 1. It will thus be appreciated that the FIGS. are schematic depictions and that other structural components may be added or existing structural components and/or processing stages may be removed or modified. Each resistor 16 of the resistor array will thus be formed as part of an actuator for ejecting ink from a nozzle. The resistor array is thus part of an actuator array configured to eject ink from an array of nozzles.

Subsequently, a dielectric layer 18, for example phosphosilicate glass (PSG), is formed, planarized, and patterned to leave contact openings to the resistor 16. Next, a dielectric passivation layer 20 and a protective layer 22 of a material such as tantalum are formed and patterned as depicted. The dielectric passivation layer 20 prevents physical contact between the resistor 16 and the possibly corrosive working fluid during use of the device, while the protective layer 22 protects the passivation layer 20 from similar ink contact.

To complete the FIG. 1 heater wafer 10, an electrode layer, for example a layer of aluminum or other conductor, is deposited using, for example, sputtering or CVD, then etched to form a first electrode 23 and a second electrode 24 such that each resistor 16 in the resistor array is individually addressable.

Figure 2:
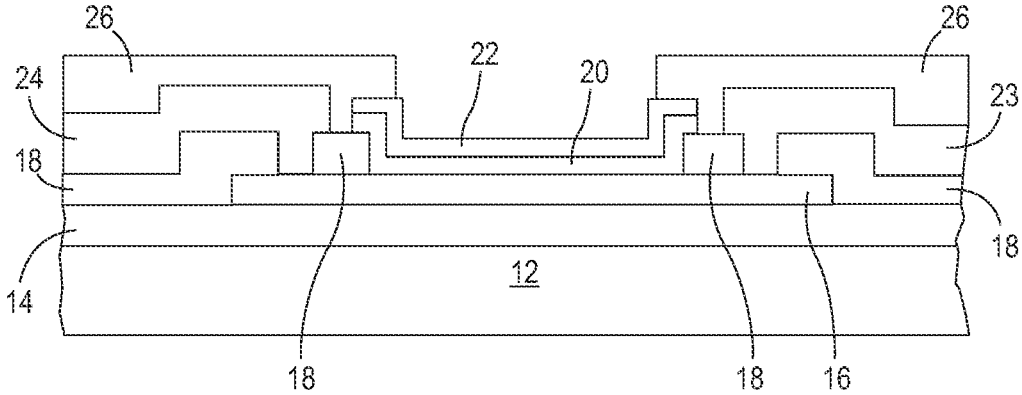

Next, as depicted in FIG. 2, a standoff layer 26, for example PSG, $SiO_2$, SU-8 photoresist, etc., is formed, planarized, and patterned as depicted. The standoff layer 26 may function as an overglaze passivation layer which provides a stable, planar base for subsequent processing as well as a containment structure for the working fluid as described below. The standoff layer 26 may also be used to determine or define a height of a working fluid chamber 40 (FIG. 4). In an embodiment, standoff layer 26 may have a thickness of between about 0.025 μm and about 2.5 μm, or between about 0.1 μm and about 0.2 μm thick, although other thicknesses are contemplated depending on the device design.

Figure 3A:
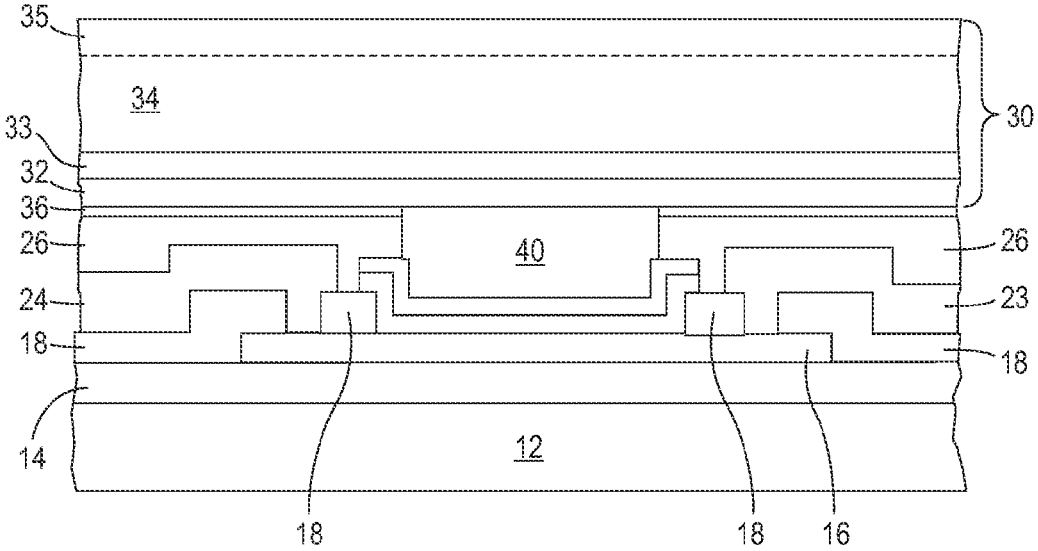

Next, a silicon-on-insulator (SOI) wafer 30 is attached to the FIG. 2 structure as depicted in FIG. 3A. The SOI wafer 30 may include a device layer, for example a monocrystalline first silicon layer having a thickness of between about 1.0 μm and about 20 μm, or between about 10 μm and about 12 μm. The SOI wafer may further include a dielectric layer 33, such as an oxide layer, for example a buried oxide layer, having a thickness of between about 0.01 μm and about 5.0 μm thick. The SOI wafer may further include a second silicon layer 34, for example a silicon handle layer (i.e., silicon handle wafer), having a thickness of between about 500 μm and about 800 μm. The buried oxide layer 33 is interposed between, and physically separates, the device layer 32 from the handle layer 34. The silicon layer 32 may be attached to the standoff layer 26 using an adhesive 36 such as an epoxy, such as a spin-coated, evaporated, vapor deposited, sprayed, etc. epoxy, a resin adhesive, or other materials that are suitably compatible with working fluid and meets processing conditions. Further, the adhesive 36 may be applied to the silicon layer 32 and/or the standoff layer 26 using, for example, screen printing, contact printing, etc. In another embodiment, the silicon layer 32 may be attached to the standoff layer 26 using an anodic or fusion bonding or metal diffusion with silver, gold, etc.

As depicted in FIG. 3A, a portion 35 of the silicon handle layer 34 may be optionally removed or planarized to thin the SOI wafer, for example decrease an etch time of a subsequent etch of the silicon handle layer 34. Removal of portion 35 may also be used to determine or define a height of an ink chamber 56 (FIG. 5). The portion 35 of handle layer 34 may be removed either before or after attachment to the standoff layer 26, but additional support provided to the SOI wafer 30 by the FIG. 2 structure after attachment may reduce or eliminate damage to the SOI wafer during the thinning process. Thinning may be performed using a chemical wet or dry etch, a mechanical dry etch, a chemical mechanical planarization (CMP), or an abrasion process.

Figure 3B:
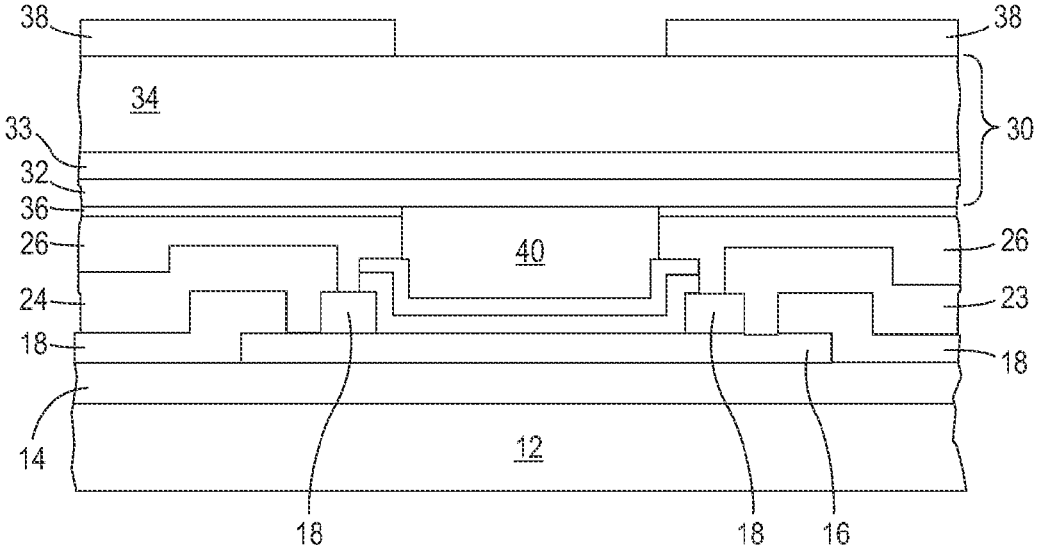

After forming the FIG. 3A structure and, optionally, removing portion 35, a patterned photoresist layer 38 may be formed over the silicon handle layer 34 as depicted in FIG. 3B, such that the patterned photoresist layer 38 exposes the silicon handle layer 34 at a location which overlies a working fluid chamber 40 as depicted. Each working fluid chamber 40 within the array of resistors 16 will be similarly exposed by the patterned photoresist layer 38.

Next, an anisotropic etch of the silicon handle layer 34 and, optionally, the oxide layer 33 is performed to form a plurality of recesses within the silicon handle layer 34 and, optionally, the oxide layer 33, wherein one recess is formed over each resistor 16 as depicted in FIG. 4. In an embodiment, the buried oxide layer 33 may be used as an etch stop during the etch of the silicon handle layer 34. Similarly, if the buried oxide layer 33 is to be optionally removed, the silicon layer 32 may be used as an etch stop during the etch of the buried oxide layer 33. A first etch chemistry may be used to etch the silicon handle layer 34 while stopping on the buried oxide layer 33, and a second etch chemistry may be used to etch the buried oxide layer 33 while stopping on the silicon layer 32. After completion of the etch, the patterned photoresist layer 38 is removed to result in a structure similar to that depicted in FIG. 4. It will be appreciated that a device formed in accordance with an embodiment of the present teachings may include various other structures known in the art that are not depicted for simplicity, such as structures that allow an ink feed manifold to be distributed across the printhead.

After forming a structure similar to that depicted in FIG. 4, a suitable nozzle plate 50 having a plurality of nozzles 52 is formed and bonded (directly attached) to the top of the SOI wafer 30 using, for example, an adhesive 54 as depicted in FIG. 5. The nozzle plate 50 may be silicon, glass, one or more of various metals such as stainless steel, a polymer, or combinations thereof. In another embodiment, the nozzle plate 50 is attached to the SOI wafer 30 using fusion or another method. Attaching the nozzle plate 50 forms an ink chamber 56 defined by the silicon layer 32, the silicon handle layer 34, and the nozzle plate 50. In a printhead having intervening features such as a manifold, ink routing layers, and/or other layers interposed between the nozzle plate 50 and the handle layer 34, the nozzle plate 50 may be indirectly attached to the handle layer 34 through contact with, and direct attachment to, the intervening feature rather than being directly attached to the handle layer 34.

After completing a structure similar to that depicted in FIG. 5, processing may continue to form a completed thermo-pneumatic actuator TIJ printhead. This may include filling the fluid chamber 40 with a working fluid 60 (FIG. 6) and filling the ink chamber 56 with ink 62. The silicon layer 32 provides, and functions in the completed printhead, as a thermo-pneumatic actuator membrane 32 to separate the working fluid chamber 40 from the ink chamber 56 across the plurality of individual actuators of the actuator array. The working fluid 60 may include, for example, ethanol, water, Fluorinert™ FC-72 (i.e., perfluorohexane) available from 3M of St. Paul, Minn., etc. Various inks 62, such as aqueous and non-aqueous inks, UV inks, gel inks, conductive inks, and biological fluids may be used in an embodiment of the present teachings.

Figure 6:
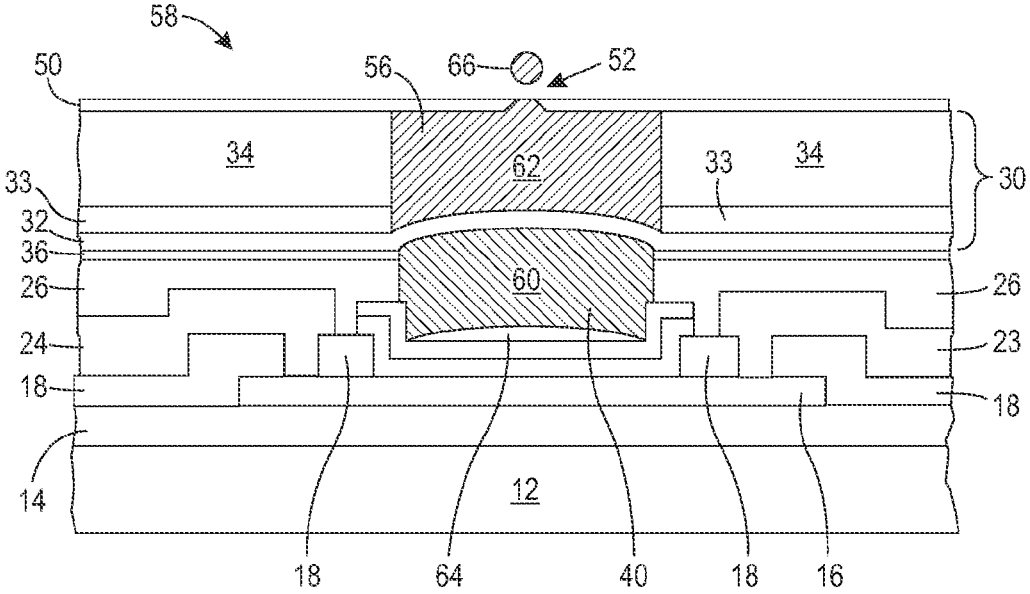

During use of the printhead as depicted in FIG. 6, the resistor 16 may be individually addressed by applying a voltage across the two electrodes 23, 24, which results in heating of the resistor 16. Once the resistor 16 reaches a critical temperature, the working fluid 60 begins to vaporize and forms a bubble 64, which pressurizes the working fluid chamber 40. The resulting pressure within the working fluid chamber 40 causes the membrane 32 to deflect, thereby decreasing a volume of the ink chamber 56. The volumetric decreases results in ejection of ink 62 from the nozzle 52 as an ink drop 66, which is thereby deposited onto a recording medium (not individually depicted for simplicity).

Figure 7:
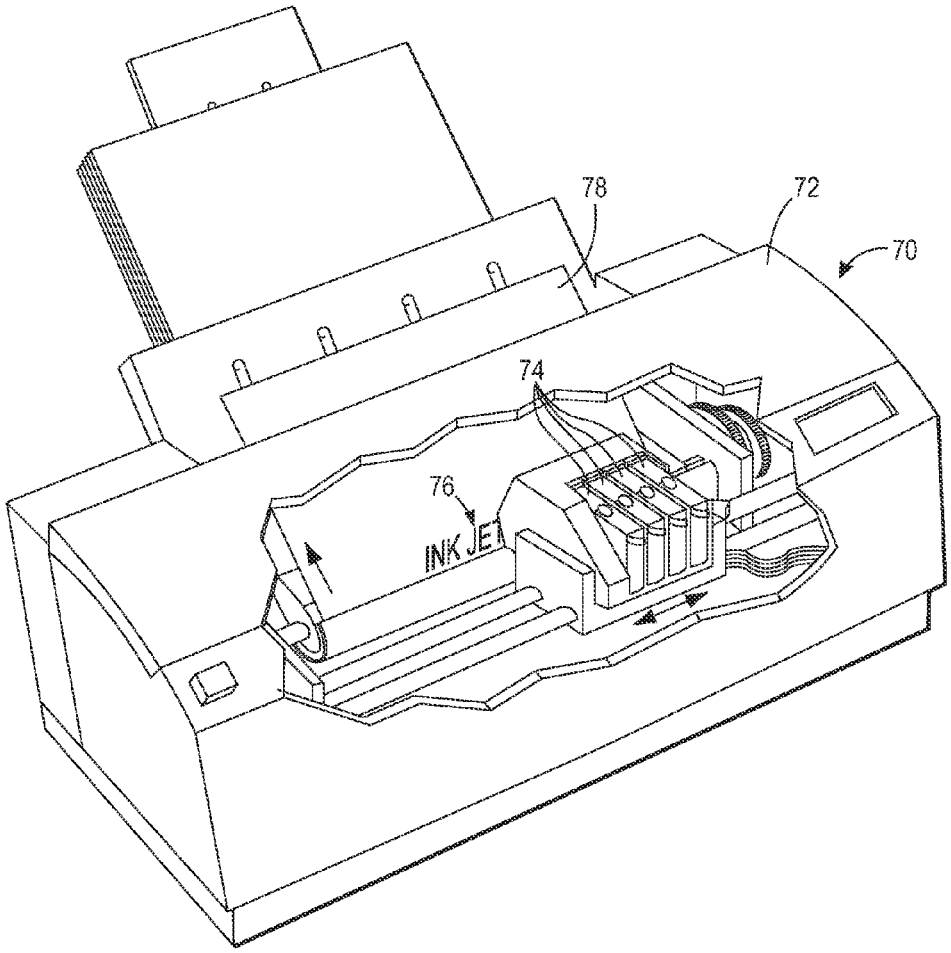
FIG. 7 is a perspective depiction of a printer in accordance with an embodiment of the present teachings.

FIG. 7 depicts a printer 70 including a printer housing 72 into which at least one printhead 74 including an embodiment of the present teachings has been installed. The housing 72 may encase the printhead 74. During operation, ink 76 is ejected from one or more printheads 74. The printhead 74 is operated in accordance with digital instructions to create a desired image on a print medium 78 such as a paper sheet, plastic, etc. The printhead 74 may move back and forth relative to the print medium 78 in a scanning motion to generate the printed image swath by swath. Alternately, the printhead 74 may be held fixed and the print medium 78 moved relative to it, creating an image as wide as the printhead 74 in a single pass. The printhead 74 can be narrower than, or as wide as, the print medium 78. In another embodiment, the printhead 74 can print to an intermediate surface such as a rotating drum, belt, or drelt (not depicted for simplicity) for subsequent transfer to a print medium.

Notwithstanding that the numerical ranges and parameters setting forth the broad scope of the present teachings are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 5. In certain cases, the numerical values as stated for the parameter can take on negative values. In this case, the example value of range stated as "less than 10" can assume negative values, e.g. −1, −2, −3, −10, −20, −30, etc.

While the present teachings have been illustrated with respect to one or more implementations, alterations and/or modifications can be made to the illustrated examples without departing from the spirit and scope of the appended claims. For example, it will be appreciated that while the process is described as a series of acts or events, the present teachings are not limited by the ordering of such acts or events. Some acts may occur in different orders and/or concurrently with other acts or events apart from those described herein. Also, not all process stages may be required to implement a methodology in accordance with one or more aspects or embodiments of the present teachings. It will be appreciated that structural components and/or processing stages can be added or existing structural components and/or processing stages can be removed or modified. Further, one or more of the acts depicted herein may be carried out in one or more separate acts and/or phases. Furthermore, to the extent that the terms "including," "includes," "having," "has," "with," or variants thereof are used in either the detailed description and the claims, such terms are intended to be inclusive in a manner similar to the term "comprising." The term "at least one of" is used to mean one or more of the listed items can be selected. Further, in the discussion and claims herein, the term "on" used with respect to two materials, one "on" the other, means at least some contact between the materials, while "over" means the materials are in proximity, but possibly with one or more additional intervening materials such that contact is possible but not required. Neither "on" nor "over" implies any directionality as used herein. The term "conformal" describes a coating material in which angles of the underlying material are preserved by the conformal material. The term "about" indicates that the value listed may be somewhat altered, as long as the alteration does not result in nonconformance of the process or structure to the illustrated embodiment. Finally, "exemplary" indicates the description is used as an example, rather than implying that it is an ideal. Other embodiments of the present teachings will be apparent to those skilled in the art from consideration of the specification and practice of the disclosure herein. It is intended that the specification and examples be considered as exemplary only, with a true scope and spirit of the present teachings being indicated by the following claims.

Terms of relative position as used in this application are defined based on a plane parallel to the conventional plane or working surface of a workpiece, regardless of the orientation of the workpiece. The term "horizontal" or "lateral" as used in this application is defined as a plane parallel to the conventional plane or working surface of a workpiece, regardless of the orientation of the workpiece. The term "vertical" refers to a direction perpendicular to the horizontal. Terms such as "on," "side" (as in "sidewall"), "higher," "lower," "over," "top," and "under" are defined with respect to the conventional plane or working surface being on the top surface of the workpiece, regardless of the orientation of the workpiece.

The invention claimed is:

1. A printhead comprising a plurality of thermo-pneumatic actuators as part of a thermo-pneumatic actuator array, wherein the thermo-pneumatic actuator array comprises:

a heater wafer comprising:

a substrate; and a plurality of resistors, wherein each resistor of the plurality of resistors is individually addressable;

a silicon-on-insulator (SOI) wafer comprising:

a device layer that provides a thermo-pneumatic actuatable membrane between a working fluid chamber and an ink chamber for each of the plurality of thermo-pneumatic actuators;

a dielectric layer attached to the device layer; and a handle layer attached to the dielectric layer, wherein the dielectric layer physically separates the device layer from the handle layer and a thickness of the handle layer determines a height of the ink chamber; and a nozzle plate comprising a plurality of nozzles, wherein the nozzle plate is attached to the handle layer.

2. The printhead of claim 1, wherein the device layer is a silicon device layer having a thickness of between 1.0 μm and 20 μm.

3. The printhead of claim 2, wherein the handle layer is a silicon handle wafer having a thickness of between about 500 μm and about 800 μm.

4. The printhead of claim 3, wherein the dielectric layer is a buried oxide layer having a thickness of between 0.01 μm and 5.0 μm.

5. The printhead of claim 1, further comprising a working fluid within the working fluid chamber.

6. The printhead of claim 1, wherein the heater wafer further comprises a patterned planarized standoff layer overlying the substrate, wherein the device layer is attached to the patterned planarized standoff layer.

7. The printhead of claim 6, wherein a thickness of the patterned planarized standoff layer determines a height of the working fluid chamber.

8. A method for forming a printhead comprising a plurality of thermo-pneumatic actuators as part of a thermo-pneumatic actuator array, wherein the method comprises:

providing a substrate and a plurality of individually addressable resistors;

forming a patterned standoff layer over the substrate, wherein an opening in the patterned standoff layer exposes a region over each resistor of the plurality of resistors;

attaching a device layer of a silicon-on-insulator (SOI) wafer to the patterned standoff layer to form a working fluid chamber from the exposed region over each resistor of the plurality of resistors, thereby forming a plurality of working fluid chambers;

etching a handle layer of the SOI wafer using a dielectric layer of the SOI wafer as an etch stop layer to form a plurality of recesses within the handle layer, wherein each recess overlies one of the resistors;

attaching a nozzle plate comprising a plurality of nozzles to the handle layer, wherein an ink chamber is defined by each recess of the plurality of recesses in the handle layer and the device layer of the SOI wafer provides a thermo-pneumatic actuatable membrane between the working fluid chamber and the ink chamber for each of the plurality of thermo-pneumatic actuators.

9. The method of claim 8, further comprising filling each of the working fluid chamber of the plurality of working fluid chambers with a working fluid.

10. The method of claim 9, further comprising filling each ink chamber of the plurality of ink chambers with ink.

11. The method of claim 8, further comprising planarizing the handle layer to thin the handle layer prior etching the handle layer to form the plurality of recesses.

12. The method of claim 8, wherein the handle layer comprises a silicon handle wafer, the device layer comprises silicon, the dielectric layer comprises oxide, and the oxide physically separates the silicon handle wafer from the silicon device layer.

13. A printer, comprising:

a printhead comprising a plurality of thermo-pneumatic actuators as part of a thermo-pneumatic actuator array, wherein the thermo-pneumatic actuator array comprises:

a heater wafer comprising:

a substrate; and a plurality of resistors, wherein each resistor of the plurality of resistors is individually addressable;

a silicon-on-insulator (SOI) wafer comprising:

a device layer that provides a thermo-pneumatic actuatable membrane between a working fluid chamber and an ink chamber for each of the plurality of thermo-pneumatic actuators;

a dielectric layer attached to the device layer; and a handle layer attached to the dielectric layer, wherein the dielectric layer physically separates the device layer from the handle layer and a thickness of the handle layer determines a height of the ink chamber; and a nozzle plate comprising a plurality of nozzles, wherein the nozzle plate is attached to the handle layer; and a printer housing that encases the printhead.

14. The printer of claim 13, wherein the device layer is a silicon device layer having a thickness of between 1.0 μm and 20 μm.

15. The printer of claim 14, wherein the handle layer is a silicon handle wafer having a thickness of between about 500 μm and about 800 μm.

16. The printer of claim 15, wherein the dielectric layer is a buried oxide layer having a thickness of between 0.01 μm and 5.0 μm.

17. The printer of claim 13, further comprising a working fluid within the working fluid chamber.

18. The printer of claim 13, wherein the heater wafer further comprises a patterned planarized standoff layer overlying the substrate, wherein the device layer is attached to the patterned planarized standoff layer.

19. The printer of claim 18, wherein a thickness of the patterned planarized standoff layer determines a height of the working fluid chamber.

20. A printhead comprising a plurality of thermo-pneumatic actuators as part of a thermo-pneumatic actuator array, wherein the thermo-pneumatic actuator array comprises:

a heater wafer comprising:

a substrate;

a plurality of resistors, wherein each resistor of the plurality of resistors is individually addressable; and a patterned planarized standoff layer overlying the substrate, wherein the device layer is attached to the planarized standoff layer;

a silicon-on-insulator (SOI) wafer comprising:

a device layer that provides a thermo-pneumatic actuatable membrane between a working fluid chamber and an ink chamber for each of the plurality of thermo-pneumatic actuators, wherein a thickness of the patterned planarized layer determines a height of the working fluid chamber;

a dielectric layer attached to the device layer; and a handle layer attached to the dielectric layer, wherein the dielectric layer physically separates the device layer from the handle layer; and a nozzle plate comprising a plurality of nozzles, wherein the nozzle plate is attached to the handle layer.

* * * * *